US010670203B1

(12) United States Patent
Glazer et al.

(10) Patent No.: US 10,670,203 B1
(45) Date of Patent: Jun. 2, 2020

(54) MODULAR LIGHT FIXTURE WITH INTERCHANGEABLE COMPONENTS

(71) Applicant: Inter-Global, Inc., St. Louis, MO (US)

(72) Inventors: Larry J. Glazer, St. Louis, MO (US); Wendell S. Dodson, St. Louis, MO (US)

(73) Assignee: Inter-Global, Inc., St. Louis, MO (US)

( * ) Notice: Subject to any disclaimer, the term of this patent is extended or adjusted under 35 U.S.C. 154(b) by 0 days.

(21) Appl. No.: 16/435,635

(22) Filed: Jun. 10, 2019

(51) Int. Cl.

| | |
|---|---|
| ***F21S 2/00*** | (2016.01) |
| ***F21S 8/00*** | (2006.01) |
| ***F21V 3/02*** | (2006.01) |
| ***F21V 15/02*** | (2006.01) |

(52) U.S. Cl.
CPC ..... *F21S 2/005* (2013.01); *F21S 8/036* (2013.01); *F21V 3/02* (2013.01); *F21V 15/02* (2013.01)

(58) Field of Classification Search
CPC ..... F21V 15/02; F21S 2/005
See application file for complete search history.

(56) References Cited

U.S. PATENT DOCUMENTS

| | | | | |
|---|---|---|---|---|
| 5,151,011 | A | 9/1992 | Rezek | |
| 5,243,508 | A * | 9/1993 | Ewing | F21S 2/005 362/431 |
| 5,562,341 | A | 10/1996 | Strauss | |
| 6,004,005 | A | 12/1999 | Demshki, Jr. | |
| 6,979,097 | B2 | 12/2005 | Elam et al. | |
| 7,445,362 | B2 | 11/2008 | Compton et al. | |
| 8,382,340 | B2 | 2/2013 | Boyer et al. | |
| 9,739,460 | B2 | 8/2017 | Haubach | |
| 10,132,475 | B2 | 11/2018 | Engle et al. | |
| 10,274,173 | B2 | 4/2019 | Schubert et al. | |

OTHER PUBLICATIONS

Gama Sonic Windsor Bulb Solar Light—With Pole, Post & Wall Mount Kit [online]. Earthtech Products, May 28, 2019. Retrieved from the Internet: <URL:https://www.earthtechproducts.com/windsor-bulb-solar-light-fpw.html>.

Inter-Global Non-Metallic Outdoor Lighting—Orchid Post [online]. Inter-Global, Inc., May 30, 2019. Retrieved from the Internet: <URL:www.interglobal-inc.com/pdf/36.pdf>.

(Continued)

*Primary Examiner* — Robert J May
(74) *Attorney, Agent, or Firm* — Creativenture Law, LLC; Dennis J M Donahue III; Kevin Staed

(57) ABSTRACT

A modular light fixture has interchangeable assemblies for a top-mount configuration and a bottom-mount configuration. The cage, lens, and roof are the assemblies that can all be interchanged between the different mounting configurations. Each one of these assemblies has the same geometrical shape in the top-mount configuration and in the bottom-mount configuration. The cage has an upper collar, a lower collar, and side rails that connect the collars. The lens is a single-piece shell that is formed in either a prismatic shape or a cylindrical shape. The roof slopes downward from a center section to an outer section. The top-mount bracket assembly for the top-mount configuration is a single-piece injection-mold plastic part which can be produced with an arm extending from a wall panel and without any finial.

20 Claims, 7 Drawing Sheets

(56) References Cited

OTHER PUBLICATIONS

Inter-Global Non-Metallic Outdoor Lighting—Orchid Wall [online]. Inter-Global, Inc., May 30, 2019. Retrieved from the Internet: <URL:www.interglobal-inc.com/pdf/37.pdf>.
Hi-Lite Ringed Icon Collection [online]. Hi-Lite Mfg. Co. Inc., May 30, 2019. Retrieved from the Internet: <URL:www.hilitemfg.com/commercial/the-ringed-icon-collection/>.
Hi-Lite Tapered Hatted Saucer Vapor Jar [online]. Hi-Lite Mfg. Co. Inc., May 30, 2019. Retrieved from the Internet: <URL:http://www.hilitemfg.com/commercial/tapered-hatted-saucer-vapor-jar/>.

* cited by examiner

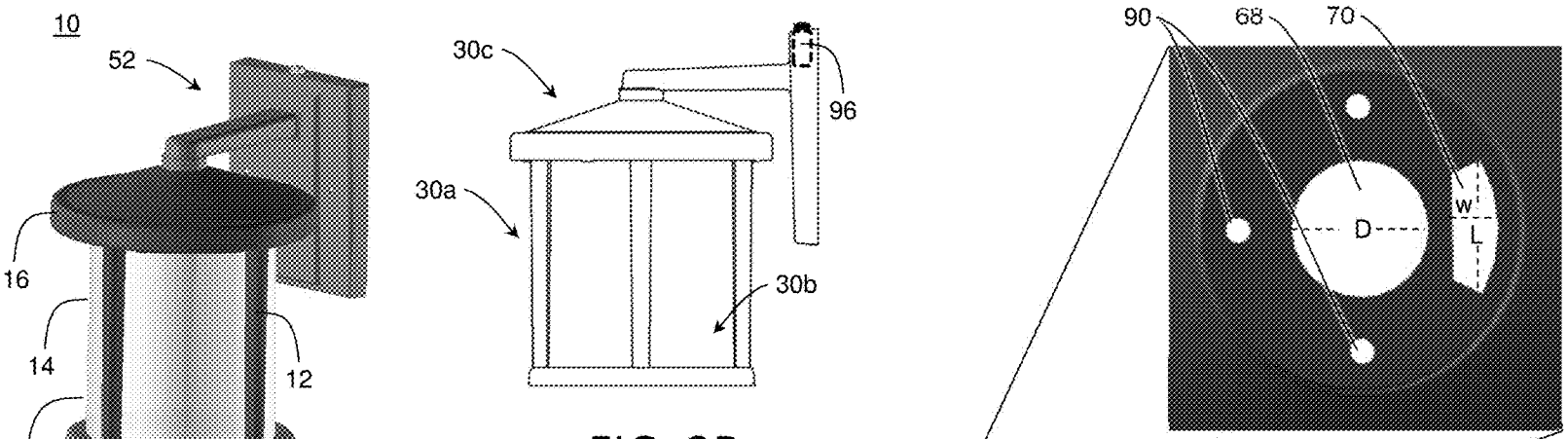
FIG. 3A
FIG. 3B
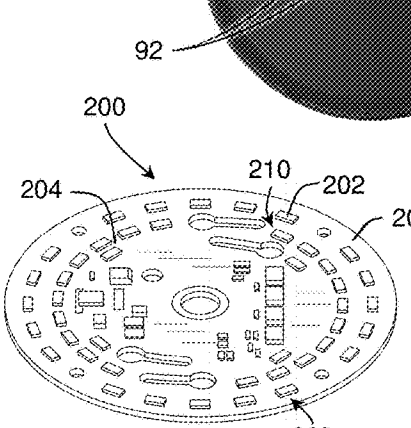
FIG. 3C
FIG. 3D
FIG. 3E

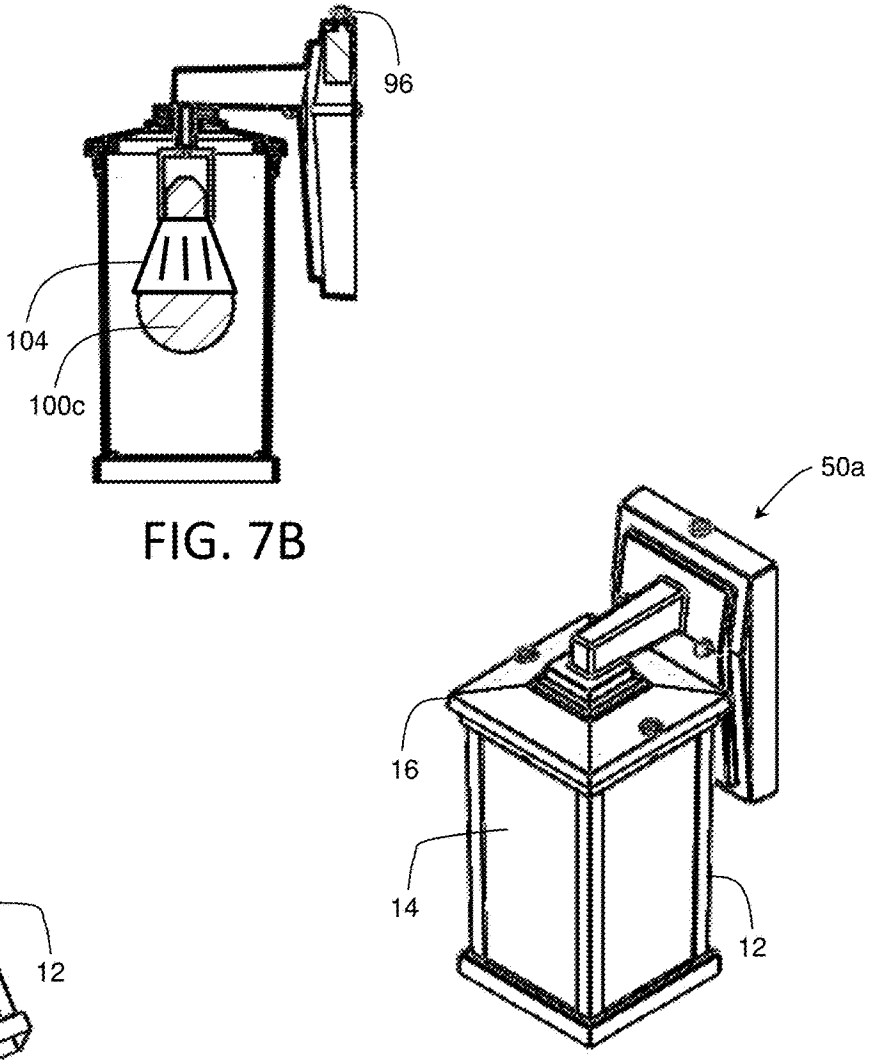
FIG. 7C
FIG. 7B
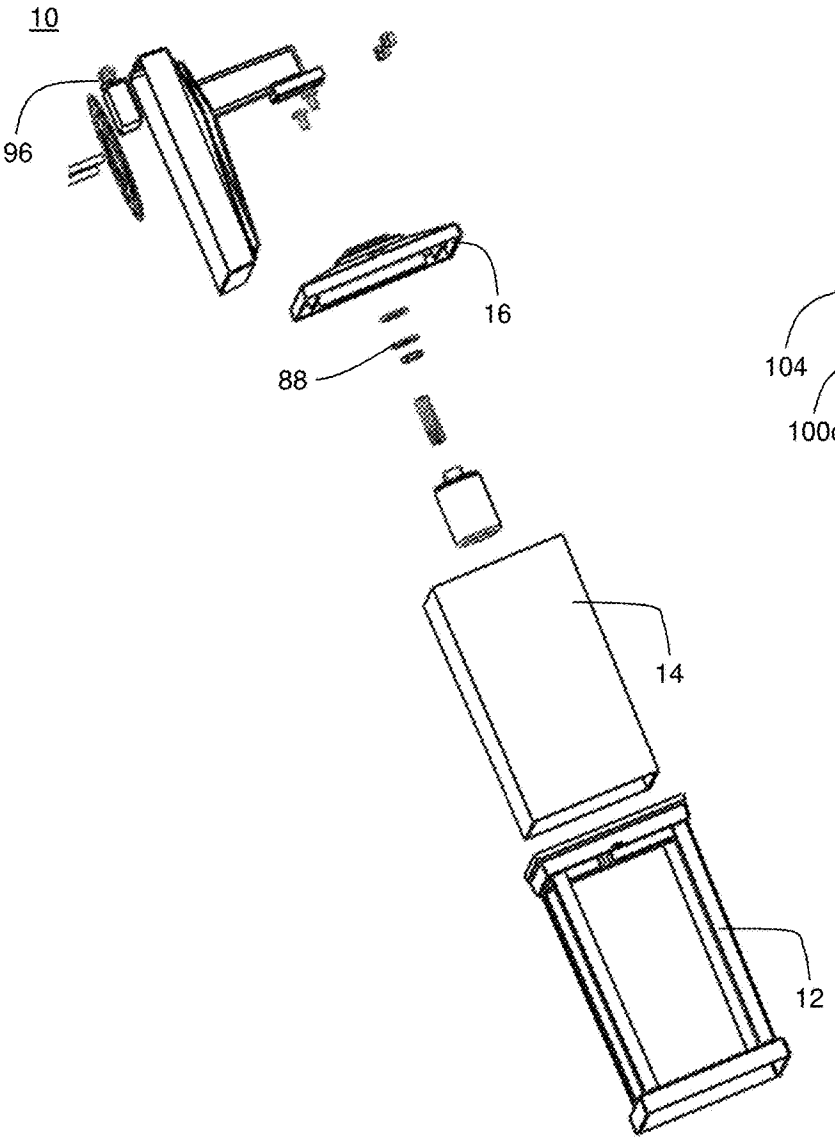
FIG. 7A

MODULAR LIGHT FIXTURE WITH INTERCHANGEABLE COMPONENTS

CROSS-REFERENCE TO RELATED APPLICATIONS

None; this application is an original filing of the invention and does not claim a right of priority to any other application or the benefit of an earlier filing date.

STATEMENT REGARDING FEDERALLY SPONSORED RESEARCH

Not Applicable.

BACKGROUND OF THE INVENTION

Field of the Invention

The present invention generally relates to the field of light fixtures, and more particularly to a modular light fixture with interchangeable components that can be used in a top-mounted light fixture or a bottom-mounted light fixture.

Related Art

Modular light fixtures have used interchangeable assemblies in combination with different types of mounting devices. For example, the GAMA SONIC® light fixture by Gama Sonic Industries includes a mounting kit that allows the same light fixture to be mounted from its base onto a post, a wall, or a flat surface by using different bottom-mount brackets. Similarly, Hi-Lite Manufacturing produces several types of light fixtures that can use the base for different types of mountings, such as Hi-Lite's "Ringed Icon Collection" style of light fixtures. However, these known light fixtures are limited to bottom-mount brackets only; they only allow for mounting brackets that support the light fixture from the base, and they do not provide any option for top-mount brackets that would hold the light fixture from its roof, such as with a top-mount wall bracket, a gooseneck bracket, a curved stem bracket, or a pendant cord/rod bracket. Hi-Lite Manufacturing produces modular light fixtures that can be mounted with these types of top-mount brackets, such as with Hi-Lite's "Tapered Hatted Saucer Vapor Jar" style of light fixtures. However, these light fixtures are limited to top-mount brackets only; they only allow for mounting brackets that support the light fixture from the roof, and they do not provide any option for bottom-mount brackets that would hold the light fixture from its base.

Increasing the interchangeability of assemblies in the light fixtures and making the light fixtures more modular can reduce the cost of parts and can also reduce the time to manufacture the light fixtures which further reduces the manufacturing costs. Towards this end, the applicant, Inter-Global, Inc., had previously introduced several types of light fixtures that could use the same mounting bracket as either a top-mount bracket or a bottom-mount bracket, and the bottom-mount bracket could be either a wall mount or a post mount. For example, the "Orchid" light fixture has been sold for years with a top-mount wall bracket, a bottom-mount wall bracket, and/or a bottom-mount post bracket. These Inter-Global light fixtures had been an improvement over the other modular light fixtures that could only be mounted with a top-mount bracket or with a bottom-mount bracket because the same cage and set of lenses could be interchangeably used in either the top-mount configuration or the bottom-mount configuration. However, these modular Inter-Global light fixtures still use a different roof for the bottom-mount bracket as compared to the top-mount bracket, and there had remained a desire for further increasing the modularity and interchangeability of the assemblies, particularly including an interchangeable roof in combination with the interchangeable cage that could work with a single-piece lens rather than a set of multiple lenses.

SUMMARY OF THE INVENTION

In one aspect of the invention, a modular light fixture has interchangeable assemblies for a top-mount configuration and a bottom-mount configuration. A cage has an upper section that connects to a top-mount bracket in the top-mount configuration and a lower section that connects to a bottom-mount bracket in the bottom-mount configuration, and the cage has an identical cage geometry in both the top-mount and bottom-mount configurations. A lens that is held by the cage is a single-piece shell formed in either a prismatic shape or a cylindrical shape which is an identical lens geometry in the top-mount and bottom-mount configurations. A roof has a center section and an outer section that slopes downward from the center section to a periphery. The roof's outer section engages with and is fastened to the cage's upper collar proximate to the periphery, and the outer section and the periphery have identical respective geometries in the top-mount and bottom-mount configurations. The cage is connected to the top-mount bracket through the roof in the top-mount configuration. A socket assembly with a light socket and an externally-threaded tube is fixed to the top-mount bracket in the top-mount configuration and is fixed to the bottom-mount bracket in the bottom-mount configuration.

In other aspects of the invention, the cage also has an intermediate section that connects the upper and lower sections, and the entire roof has an identical roof geometry in both the top-mount and bottom-mount configurations with a central aperture in the center section of the roof. The upper and lower sections are collars, and side bars form the intermediate section. A cover can be attached to the roof over the roof's center section for the top-mount configuration. The roof's center section can also have an off-set aperture with a length almost equal to the diameter of the central aperture and a width that is less than the length.

In yet another aspect of the invention, a family of light fixtures with the same assemblies for the cage, lens, and roof can be made with some light fixtures having the top-mount configuration and other light fixtures having the bottom-mount configuration. The light fixtures remain in the same family regardless of whether they have a top-mount or bottom-mount configuration because they share the same assemblies regardless of the type of mount.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 3A is a perspective view of a light fixture with a cylindrical lens in a top-mount configuration.

FIGS. 3B and 3C respectively show a side view and a front view of the light fixture shown in FIG. 3A.

FIG. 3D is a bottom view of the roof and bracket of the light fixture shown in FIG. 3A and includes a detail view of the center section of the roof.

FIG. 3E is a view of an alternative lighting element with an LED assembly.

FIG. 7A is an exploded view of another top-mount, prismatic lens light fixture.

FIGS. 7B and 7C respectively show a side cross-sectional view and a perspective view of the light fixture shown in FIG. 7A.

DETAILED DESCRIPTION OF THE PREFERRED EMBODIMENTS

The following description of the preferred embodiment(s) is merely exemplary in nature and is in no way intended to limit the invention, its application, or uses.

Figure 1D:
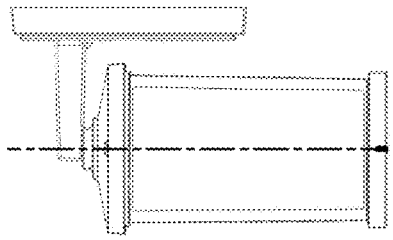
FIGS. 1D, 1E, 1F, and 1G respectively show a side view, a top view, a bottom view, and a perspective view of the light fixture shown in FIG. 1A.
Figure 1C:
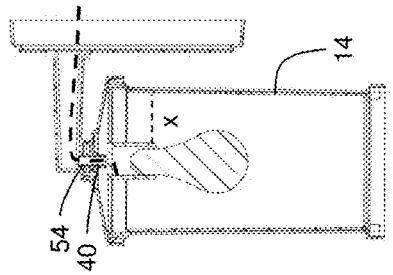
FIG. 1C is a side cross-sectional view of the light fixture shown in FIG. 1A.
Figure 1B:
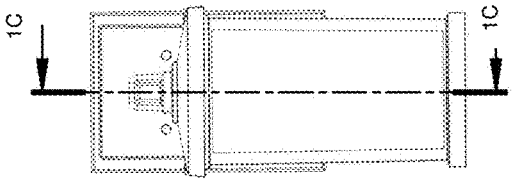
FIG. 1B is a front view of the light fixture shown in FIG. 1A.
Figure 1G:
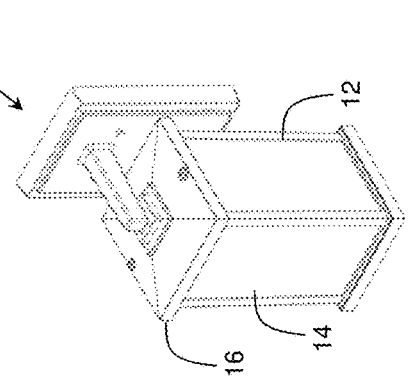
Figure 1F:
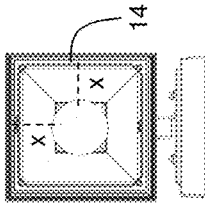
Figure 1E:
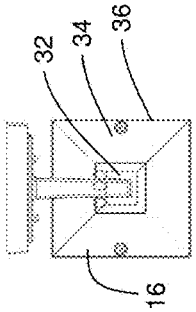
Figure 1A:
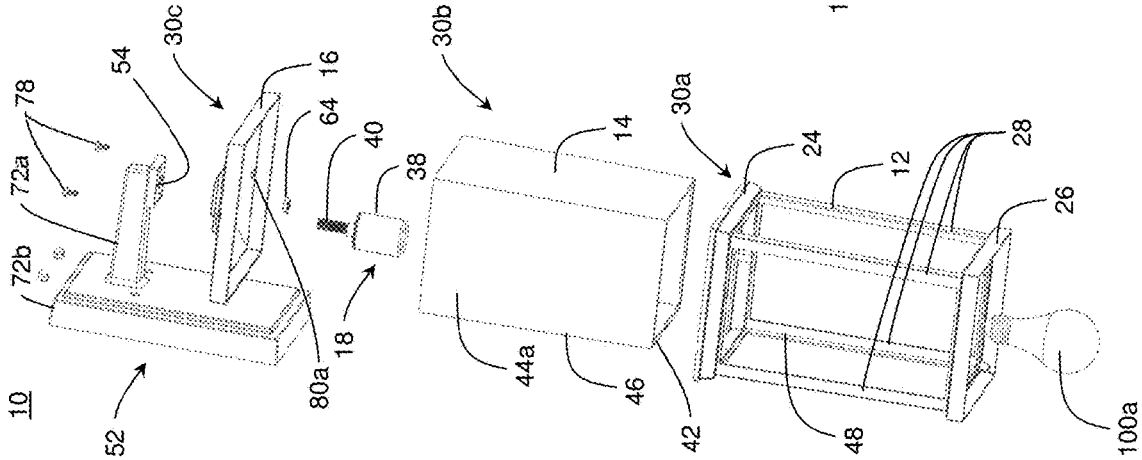
FIG. 1A is an exploded view of a light fixture with a prismatic lens in a top-mount configuration.
Figure 2A:
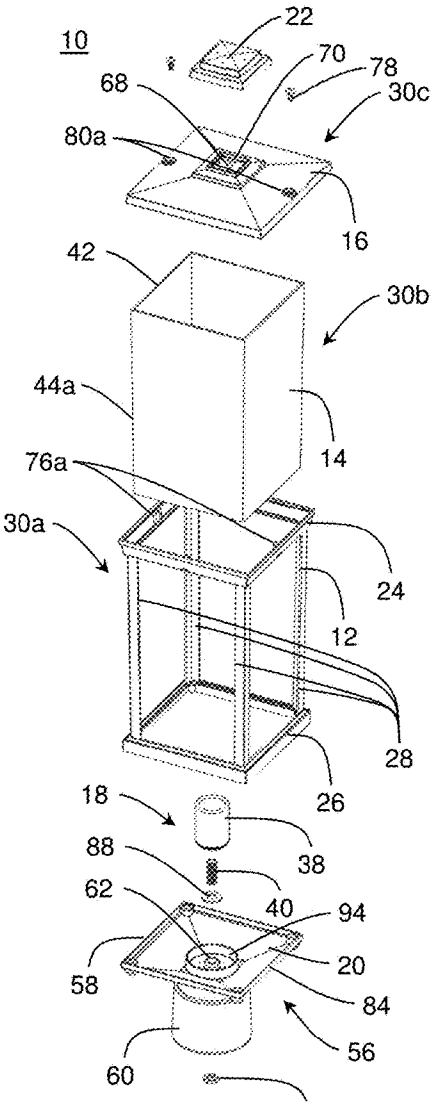
FIG. 2A is an exploded view of a light fixture corresponding to the light fixture shown in FIG. 1A in a bottom-mount configuration.
Figure 2B:
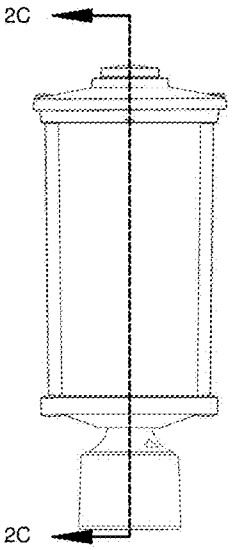
FIG. 2B is an elevation view of the light fixture shown in FIG. 2A.
Figure 2C:
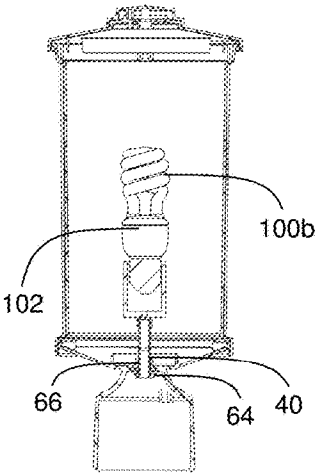
FIG. 2C is a side cross-sectional view of the light fixture shown in FIG. 2A.
Figure 2D:
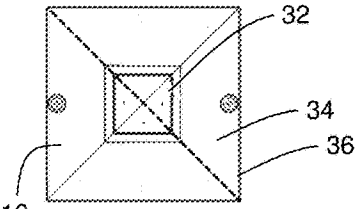
FIGS. 2D, 2E, and 2F respectively show a top view, a bottom view, and a perspective view of the light fixture shown in FIG. 2A.
Figure 2E:
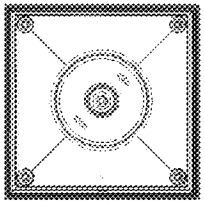
Figure 2F:
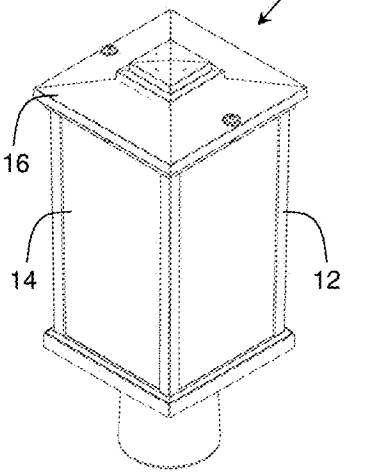

The modular light fixture 10 shown in FIGS. 1A-1G and FIGS. 2A-2F has interchangeable cage 12, lens 14, and roof 16 components with identical geometries which are arranged in a top-mount configuration 50*a* with a top-mount bracket assembly 52 in FIGS. 1A-1G and in a bottom-mount configuration 50*b* with a bottom-mount bracket assembly 54 in FIGS. 2A-2F. The top-mount bracket assembly is preferably formed as a single-piece injection-mold plastic part 72 which can be produced with an arm 72*a* extending from a wall panel 72*b* and without the need for any finial. The single-piece mounting bracket 72 is preferably a thin-walled shell so that the power wire 86 can extend through a hollow arm to the socket assembly 18, and a light sensor 96 can fit in the wall panel.

As interchangeable components, the cage 12, lens 14, and roof 16 have the same respective geometries. For the components in this embodiment and for each embodiment described below, the identical geometry 30 refers to the same shape and dimensions of each respective component so that the particular component is interchangeable between the top-mount configuration and the bottom-mount configuration. The socket assembly 18 is preferably connected to the light fixture 10 through the bracket assembly, but it will be appreciated that the socket assembly could be connected to the light fixture 10 opposite from the bracket assembly, such as by running the power wire 86 inside the lens. The socket assembly has a light socket 38 and an externally-threaded tube 40 which can be held tight to the bracket with a nut 64 that screws over an end 66 of the externally-threaded tube which may also have a washer 88 around it. All of the bottom-mount configurations and some of the top-mount configurations also have a base 20 that is connected to the lower collar.

Generally, the cage 12 has an upper section 12*a* and a lower section 12*b* and may also have intermediate section 12*c* connecting the upper section to the lower section. The upper section connects to the top-mount bracket assembly in the top-mount configuration, and the lower section connects to the bottom-mount bracket assembly in the bottom-mount configuration. The cage has an identical cage geometry 30*a* in both the top-mount configuration and the bottom-mount configuration. As particularly shown in the drawings, the upper section and lower section of the cage can be an upper collar 24 and a lower collar 26, respectively, and the intermediate section of the cage can be a set of side rails 28.

Figure 4D:
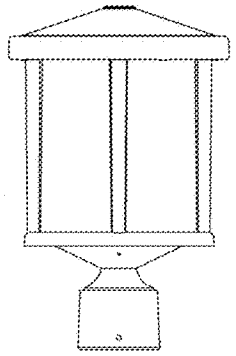
FIGS. 4D, 4E, 4F, 4G, and 4H respectively show a top view, a bottom view, a bottom perspective view, and a top perspective view of the light fixture shown in FIG. 4A.
Figure 4C:
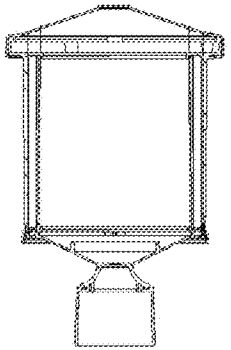
FIG. 4C is a side cross-sectional view of the light fixture shown in FIG. 4A.
Figure 4B:
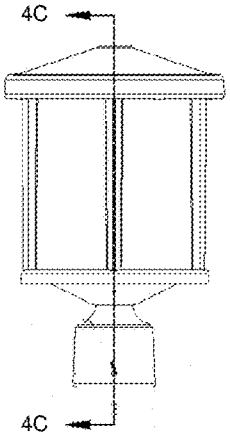
FIG. 4B is an elevation view of the light fixture shown in FIG. 4A.
Figure 4H:
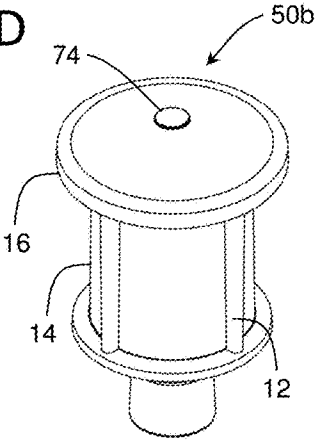
Figure 4G:
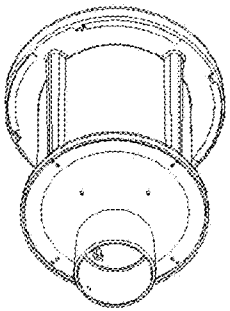
Figure 4F:
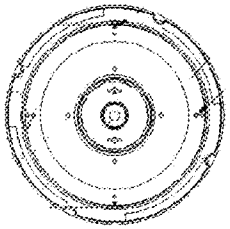
Figure 4E:
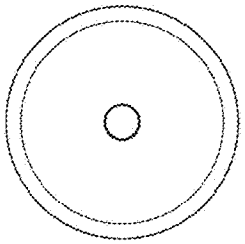
Figure 4A:
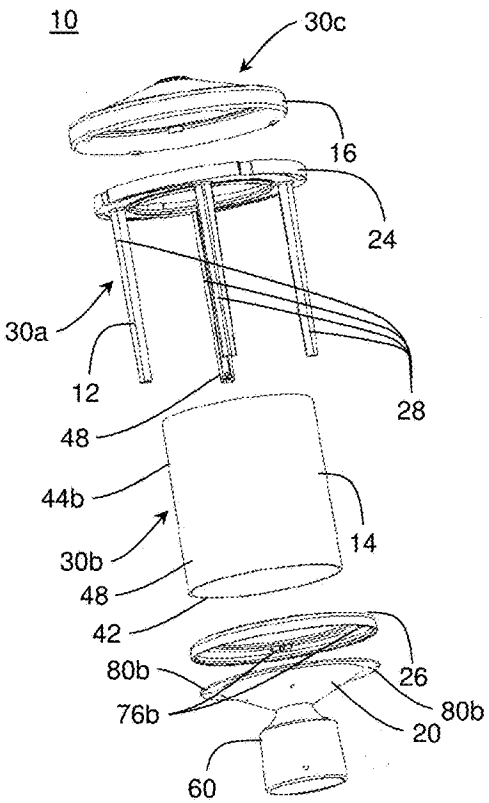
FIG. 4A is an exploded view of a light fixture corresponding to the light fixture in FIG. 3A in a bottom-mount configuration.
Figure 5C:
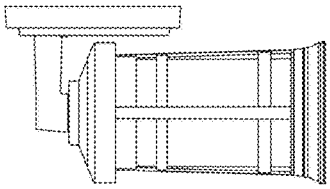
FIGS. 5B, 5C, 5D, 5E, and 5F respectively show a front view, a side view, a top view, a bottom view, and a perspective of the light fixture shown in FIG. 5A.
Figure 5B:
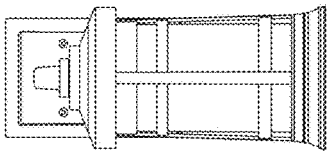
Figure 5D:
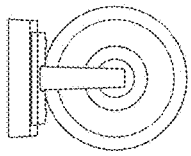
Figure 5E:
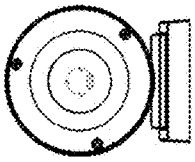
Figure 5F:
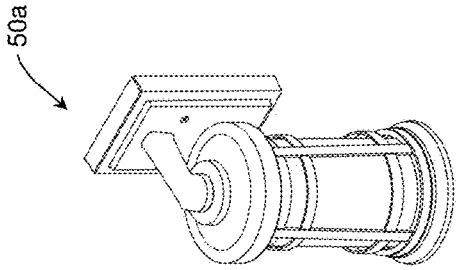
Figure 5A:
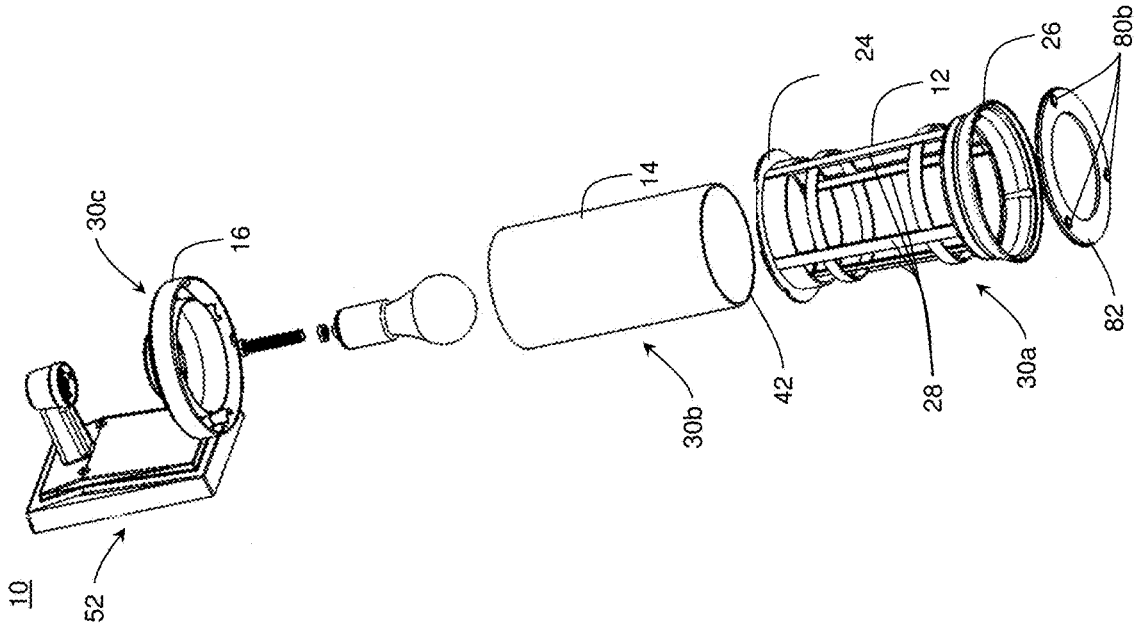
FIG. 5A is an exploded view of another top-mount, cylindrical lens light fixture.
Figure 6A:
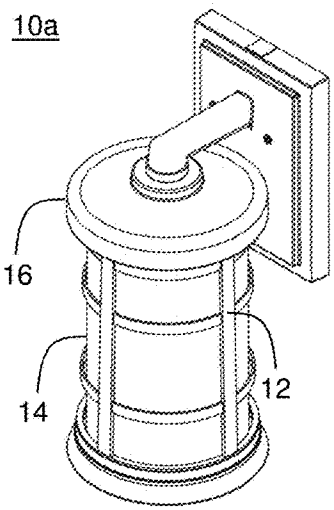
FIGS. 6A, 6B, 6C, and 6D respectively show a perspective view, a side view, a front view, and a top view of another top-mount light fixture with a cylindrical lens.
Figure 6B:
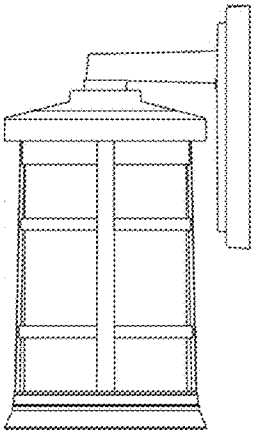
Figure 6D:
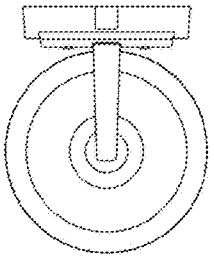
Figure 6C:
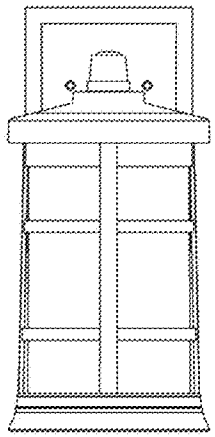
Figure 6E:
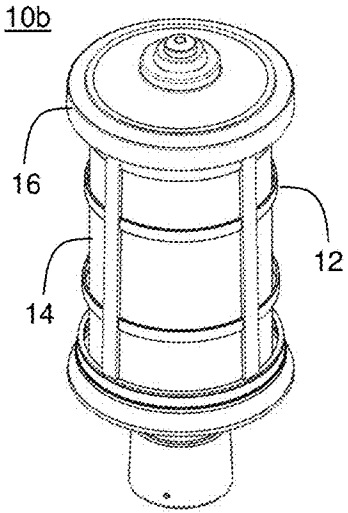
FIGS. 6E and 6F respectively show a top perspective view and an elevation view of a light fixture corresponding to the light fixture in FIG. 6A in a bottom-mount configuration.
Figure 6F:
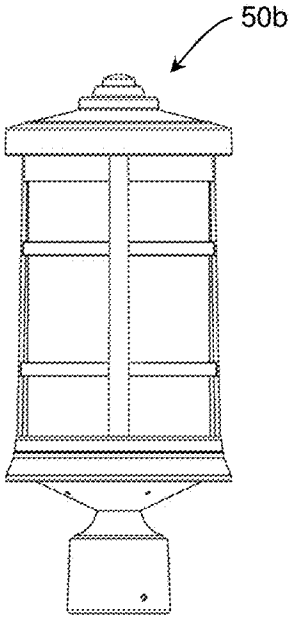

The lens 14 is held within the cage and is a preferably formed from an acrylic thermoplastic material as a single-piece, thin-walled shell 42. As shown in FIGS. 1A-1G, 2A-2F, and 7A-7C, the lens can be formed in a prismatic shape 44*a* which corresponds to the polygonal geometries of the cage and roof in these light fixtures 10. As shown in FIGS. 3A-3D, 4A-4H, 5A-5F, and 6A-6F, the lens can alternatively a cylindrical shape 44*b* which corresponds to the curved geometries of the cage and roof in these light fixtures. Generally, the lens is positioned at a distance (x) around the socket assembly with an upper surface 14*a* of the lens contacting the cage's upper section 12*a* and a lower surface 14*b* of the lens contacting the cage's lower section 12*b*. The lens has an identical lens geometry 30*b* in both the top-mount configuration and the bottom-mount configuration. In some light fixture configurations, the lens can serve as the cage's intermediate section with the upper collar and lower collar being respectively connected to the top and bottom of the lens. It will be appreciated that the lens can be made with various plastic materials or glass and can be transparent or translucent.

The roof 16 has a center section 32 and an outer section 34 that slopes downward from the center section to the roof's periphery 36. The outer section of the roof engages with and is fastened to the upper collar 24 of the cage proximate to the periphery. In all of the top-mount configurations, the roof's center section has a central aperture 68 through which the socket assembly's externally-threaded tube 40 extends to screw into an internally-threaded tube 54 in the top-mount bracket assembly 52. For those bottom-mount configurations which use the same roof with an identical geometry, such as the prismatic configuration shown in FIGS. 2A-2F and the cylindrical configurations shown in FIGS. 5A-5F and in FIGS. 6E and 6F, a cover 22 is attached to the roof's center section over the central aperture 68.

It will also be appreciated that the roof 16 could be formed with a solid panel 74 in the center section 32 for the bottom-mount configuration 50*b*. In such a case, the outer section and the periphery have identical respective geometries in both the top-mount configuration and the bottom-mount configuration, but the roof's center section in the top-mount configuration would have the central aperture while the roof's center section in the bottom-mount configuration would have the solid panel rather than a separate cover for the bottom-mount configuration. For example, the top-mount configuration shown in FIGS. 3A-3D has the central aperture 68 in the roof's center section while the bottom-mount configuration shown in FIGS. 4A-4H has the solid panel 74 in the roof's center section.

The center section 32 in the roof 16 preferably also includes an off-center aperture 70 positioned between the central aperture 68 and the outer section 34. The off-center aperture 70 is particularly shown in the detail view of FIG. 3D. The off-center aperture has a length (L) approximately equal to the central aperture's diameter (D) and a width (w) less than the length and greater than one half the central aperture's radius (r=d/2). Persons skilled in the art of light fixture design will appreciate that the central aperture 68 can receive the wiring used for traditional light sockets 38 that hold different types of screw-in bulbs 100, such as incandescent bulbs 100*a*, compact fluorescent lamps 100*b* with electronic ballasts 102, and LED bulbs 100*c* with AC-DC driver circuitry 104, while the off-center aperture 70 can be used for wiring bundles used with LED assemblies 200 that do not require the traditional light socket. The center section can also have smaller offset apertures 90 through which small screws 78 can extend into corresponding screw holes 92 in the bracket to hold the roof to the bracket before the socket assembly is screwed into the bracket. Other devices can temporarily hold the roof to the bracket, such as snap-fit connections. When the socket assembly is screwed into the bracket, the roof's center section is held in a clamping arrangement between the socket and the top-mount.

The roof 16 has apertures 80*a* in its outer section proximate to the periphery that are aligned with internally threaded segments 76*a* in the cage's upper section. Screws 78 extend through the apertures into internally threaded segments to fasten the roof to the upper section of the cage in both the top-mount configuration 50*a* and the bottom-mount configuration 50*b*. In the top-mount configurations, the base 20 can be a lens support plate 82, such as particularly shown in FIG. 5A. In the bottom-mount configurations, the base is a mounting bracket section 84. The cage's lower section also has internally threaded segments 76*b* that are aligned with apertures 80*b* in the base, and screws extend through the base's apertures into the internally threaded segments to fasten the base to the lower section of the cage in the top-mount and bottom-mount configurations.

The bottom-mount bracket assembly 56 has the base section 58 that is preferably formed in a single-piece injection-mold plastic part with a seat 94 for the socket assembly and a support section 60 for mounting to a post. The seat is positioned between the base section and the support section, and an unthreaded hole 62 extends through the center of the seat. The externally-threaded tube of the socket assembly extends through the unthreaded hole and is secured by a nut 64 on the side of the hole that is opposite from the socket to hold the socket assembly to the base section. The base section connects to the lower collar of the cage and is held between the socket assembly and the support section for bottom-mount brackets which have a support section separate from the base section.

FIG. 3E particularly shows an example of a LED light assembly 200 with LED strings 202, 204 that are arranged on a circuit board 206 that will fit easily within an LED light unit. The strings are preferably arranged on the circuit board in a particular physical configuration that can match the shape of the light fixture 10. For example, the light assembly shown in FIG. 3E is circular and would fit well in the cylindrical light fixture shown in FIGS. 3A-3D. One string of LEDs 202 can be distributed along an outer ring 208 of the circular PCB substrate. The other LEDs 204 can be distributed along inner rings 210 of the circular board to help distribute the light output of the whole LED light assembly.

The embodiments were chosen and described to best explain the principles of the invention and its practical application to persons who are skilled in the art. Modifications could be made to the exemplary embodiments without departing from the scope of the invention so it is intended that all matter contained in the foregoing description and shown in the accompanying drawings are illustrative rather than limiting. For example, although the illustrations only show a wall mounting bracket as an example of a top-mount bracket assembly and a post mounting bracket as an example of a bottom-mount bracket assembly, the present invention can be used with any type of top-mount and bottom-mount bracket assemblies. In addition to the top-mount wall bracket described above, examples of top-mount brackets include gooseneck brackets, curved stem brackets, and pendant cord/rod brackets. In addition to the bottom-mount post bracket described above, examples of bottom-mount brackets include bottom-mount wall brackets and horizontal surface brackets. Thus, the breadth and scope of the present invention should not be limited by any of the above-described exemplary embodiments, but should be defined only in accordance with the following claims appended hereto and their equivalents.

What is claimed is:

1. A plurality of modular light fixtures, comprising:

a first light fixture comprising a top-mount;

a second light fixture comprising a bottom-mount;

a cage comprising an upper collar, a lower collar, and a plurality of side rails connecting the upper collar to the lower collar, wherein one of the upper collar and the lower collar connects to the top-mount of the first light fixture and the bottom-mount of the second light fixture, respectively, and wherein the cage has an identical cage geometry for both the first light fixture and the second light fixture;

a lens held within the cage by the side rails, wherein the lens has an identical lens geometry for both the first light fixture and the second light fixture; and a roof comprising a center section and an outer section, wherein the outer section slopes downward from the center section to a periphery, wherein the outer section of the roof engages with and is fastened to the upper collar of the cage proximate to the periphery, wherein the outer section and the periphery have identical respective geometries for both the first light fixture and the second light fixture, and wherein the cage is connected to the top-mount through the roof for the first light fixture.

2. The modular light fixtures of claim 1, further comprising a socket assembly, wherein the socket assembly is comprised of a light socket and an externally-threaded tube, and wherein the socket assembly is fixed to the top-mount for the first light fixture and is fixed to the bottom-mount for the second light fixture, wherein the lens is a single-piece shell formed in at least one of a prismatic shape and a cylindrical shape, wherein the lens is positioned at a distance around the socket assembly, and wherein an outer surface of the lens contacts an inner surface of the side rails.

3. The modular light fixtures of claim 2, wherein the top-mount is further comprised of a first mounting bracket assembly having an internally-threaded tube, wherein the externally-threaded tube of the socket assembly extends through the central aperture for the first light fixture and screws into the first internally-threaded tube to connect the socket to the top-mount, wherein the center section in the roof is held between the socket assembly and the top-mount, wherein the bottom-mount is further comprised of a second mounting bracket assembly having a base section, a support section, and an unthreaded hole, wherein the externally-threaded tube of the socket assembly extends through the unthreaded hole and a nut screws onto a side of the externally-threaded tube opposite from the light socket, and wherein the base section connects to the lower collar of the cage.

4. The modular light fixtures of claim 1, wherein the center section in the roof is further comprised of a central aperture.

5. The modular light fixtures of claim 4, wherein the center section in the roof is further comprised of at least one off-center aperture positioned between the central aperture and the outer section, and wherein the top-mount is further comprised of a single-piece mounting bracket assembly with an arm extending from a wall panel and without any finial on the arm.

6. The modular light fixtures of claim 5, wherein the off-center aperture has a length approximately equal to a diameter of the central aperture and a width less than the length and greater than one half a radius of the central aperture.

7. The modular light fixtures of claim 4, further comprising a cover attached to the roof over the central aperture in the center section for the second light fixture, wherein the center section of the roof has an identical geometry for both the first light fixture and the second light fixture, and wherein the roof has an identical roof geometry for both the first light fixture and the second light fixture.

8. The modular light fixtures of claim 1, wherein the center section in the roof is a solid panel for the second light fixture.

9. The modular light fixtures of claim 1, wherein the upper collar of the cage is further comprised of a set of internally threaded segments for receiving a set of screws, wherein the roof is further comprised of a set of apertures in the outer section proximate to the periphery and aligned with the internally threaded segments, and wherein the screws extend through the apertures and into the internally threaded segments in fastening the roof to the cage for both the first light fixture and the second light fixture.

10. The modular light fixtures of claim 1, further comprising a base connected to the lower collar of the cage, wherein the lower collar is further comprised of a set of internally threaded segments for receiving a set of screws, wherein the base is further comprised of a set of apertures respectively aligned with the internally threaded segments, wherein the screws extend through the apertures in the base and into the internally threaded segments in fastening the base to the lower collar, wherein the base is one of a lens support plate for the first light fixture and a mounting bracket section for the second light fixture.

11. A modular light fixture with interchangeable components for a first configuration having a top-mount bracket assembly and a second configuration having a bottom-mount bracket assembly, comprising:

a cage comprising an upper collar, a lower collar, and a plurality of side rails connecting the upper collar to the lower collar, wherein the upper collar connects to the top-mount bracket assembly in the first configuration, wherein the lower collar connects to the bottom-mount bracket assembly in the second configuration, and wherein the cage has an identical cage geometry in both the first configuration and the second configuration;

a lens held within the cage by the side rails, wherein the lens is a single-piece shell formed in at least one of a prismatic shape and a cylindrical shape, wherein an outer surface of the lens contacts an inner surface of the side rails, and wherein the lens has an identical lens geometry in both the first configuration and the second configuration; and a roof comprising a center section and an outer section, wherein the center section comprises a central aperture, wherein the outer section slopes downward from the center section to a periphery, wherein the outer section of the roof engages with and is fastened to the upper collar of the cage proximate to the periphery, wherein the cage is connected to the top-mount bracket assembly through the roof in the first configuration, and wherein the roof has an identical roof geometry in both the first configuration and the second configuration.

12. The modular light fixture of claim 11, wherein the upper collar of the cage is further comprised of a set of internally threaded segments for receiving a set of screws, wherein the roof is further comprised of a set of apertures in the outer section proximate to the periphery and aligned with the internally threaded segments, and wherein the screws extend through the apertures and into the internally threaded segments in fastening the roof to the cage in both the first configuration and the second configuration.

13. The modular light fixture of claim 11, further comprising a base attached to the lower collar, wherein the lower collar is further comprised of a set of internally threaded segments for receiving a set of screws, wherein the base has a set of apertures aligned with the internally threaded segments, wherein the screws extend through the set of apertures in the base and into the internally threaded segments in fastening the base to the lower collar, wherein the base is comprised of a lens support plate in the first configuration, and wherein the base is comprised of a mounting bracket section in the second configuration.

14. The modular light fixture of claim 11, further comprising a socket assembly and a cover, wherein the socket assembly is comprised of a light socket and an externally-threaded tube, wherein the socket assembly is fixed to the top-mount bracket assembly in the first configuration and is fixed to the bottom-mount bracket assembly in the second configuration, wherein the cover is attached to the roof over the central aperture in the center section in the second configuration.

15. The modular light fixture of claim 11, further comprising a single-piece mounting bracket assembly for the top-mount bracket assembly with an arm extending from a wall panel and without any finial on the arm, wherein the center section in the roof further comprises at least one off-center aperture positioned between the central aperture and the outer section, and wherein the off-center aperture has a length approximately equal to a diameter of the central aperture and a width less than the length.

16. A modular light fixture with interchangeable components for a top-mount configuration having a top-mount bracket assembly and a bottom-mount configuration having a bottom-mount bracket assembly, comprising:

a socket assembly, wherein the socket assembly is comprised of a light socket and an externally-threaded tube, and wherein the socket assembly is fixed to the top-mount bracket assembly in the top-mount configuration and is fixed to the bottom-mount bracket assembly in the bottom-mount configuration;

a cage comprising an upper section and a lower section, wherein the upper section connects to the top-mount bracket assembly in the top-mount configuration, wherein the lower section connects to the bottom-mount bracket assembly in the bottom-mount configuration, and wherein the cage has an identical cage geometry in both the top-mount configuration and the bottom-mount configuration;

a lens held by the cage, wherein the lens is a single-piece shell formed in at least one of a prismatic shape and a cylindrical shape, wherein the lens is positioned at a distance around the socket assembly with an upper surface of the lens contacting the upper section of the cage and a lower surface of the lens contacting the lower section of the cage, and wherein the lens has an identical lens geometry in both the top-mount configuration and the bottom-mount configuration; and a roof comprising a center section and an outer section, wherein the outer section slopes downward from the center section to a periphery, wherein the outer section of the roof engages with and is fastened to the upper section of the cage proximate to the periphery, wherein the outer section and the periphery have identical respective geometries in both the top-mount configuration and the bottom-mount configuration, and wherein the cage is connected to the top-mount through the roof in the top-mount configuration.

17. The modular light fixture of claim 16, wherein the center section in the roof is further comprised of one of a central aperture and a solid panel, wherein the cage is further comprised of an intermediate section connecting the upper section to the lower section, wherein the upper section is an upper collar, wherein the lower section, is a lower collar, wherein the intermediate section is a plurality of side rails, and wherein an outer surface of the lens contacts an inner surface of the side rails.

18. The modular light fixture of claim 17, further comprising a cover attached to the roof over the central aperture in the center section in the bottom-mount configuration, wherein the center section of the roof has an identical geometry in both the first light configuration and the bottom-mount configuration, and wherein the roof has an identical roof geometry in both the top-mount configuration and the bottom-mount configuration.

19. The modular light fixture of claim 16, further comprising a base connected to the lower section of the cage, wherein the base is comprised of a lens support plate in the top-mount configuration, and wherein the base is comprised of a mounting bracket section in the bottom-mount configuration.

20. The modular light fixture of claim 19, further comprising a single-piece mounting bracket assembly for the top-mount bracket assembly, wherein the single-piece mounting bracket assembly comprises an arm extending from a wall panel without any finial on the arm, wherein the upper section of the cage is further comprised of a first set of internally threaded segments for receiving a first set of screws, wherein the roof is further comprised of a first set of apertures in the outer section proximate to the periphery and aligned with the first set of internally threaded segments, wherein the first set of screws extend through the first set of apertures into the first set of internally threaded segments in fastening the roof to the upper section of the cage in both the top-mount configuration and the bottom-mount configuration, wherein the lower section of the cage is further comprised of a second set of internally threaded segments for receiving a second set of screws, wherein the base has a second set of apertures aligned with the second set of internally threaded segments, and wherein the second set of screws extend through the second set of apertures into the second set of internally threaded segments in fastening the base to the lower section of the cage in both the top-mount configuration and the bottom-mount configuration.

* * * * *